US006904830B1

(12) United States Patent
Desaulniers

(10) Patent No.: US 6,904,830 B1
(45) Date of Patent: Jun. 14, 2005

(54) BROKEN BULB REMOVER

(75) Inventor: Yvon J. Desaulniers, Wolcott, CT (US)

(73) Assignee: Alden Corporation, Wolcott, CT (US)

( * ) Notice: Subject to any disclaimer, the term of this patent is extended or adjusted under 35 U.S.C. 154(b) by 0 days.

(21) Appl. No.: 10/778,294

(22) Filed: Feb. 13, 2004

(51) Int. Cl.[7] ..... B25B 7/12
(52) U.S. Cl. ..... 81/53.11; 81/302
(58) Field of Search ..... 81/53.11, 53.12, 81/302, 418–420, 424.5, 426, 426.5

(56) References Cited

U.S. PATENT DOCUMENTS 2,334,781 A * 11/1943 Maines ..... 81/302
3,153,957 A * 10/1964 Madeira ..... 81/426.5
4,554,848 A * 11/1985 Galletto ..... 81/447
4,907,477 A * 3/1990 Farber ..... 81/302
5,371,658 A * 12/1994 Christie ..... 362/109
5,386,744 A * 2/1995 Garcia ..... 81/53.11
5,458,029 A * 10/1995 Walsky ..... 81/302
6,739,219 B1 * 5/2004 Cuevas ..... 81/53.1

* cited by examiner

*Primary Examiner*—David B. Thomas
(74) *Attorney, Agent, or Firm*—McCormick, Paulding & Huber LLP

(57) ABSTRACT

Broken bulb remover for removing a broken light bulb by twisting the glass stem protruding from the remnants of the broken bulb. A pair of longitudinal members of non-conductive material with handles on one end and semi-cylindrical engagement sections on the other end is connected together for pivoting about a fulcrum pin and socket. The engagement sections have silicone tabs for centering and stabilizing the tool when the handle sections are squeezed. Internal radial ribs on the engagement sections enclose and twist the glass stem to remove the broken bulb. A transparent non-conductive shield is mounted around the fulcrum sections to protect against electrical shock and broken glass.

10 Claims, 3 Drawing Sheets

BROKEN BULB REMOVER

BACKGROUND OF THE INVENTION

This invention relates to a tool or accessory for removing broken bulbs from electrical light fixtures.

A well-known problem arises when an electric light bulb is inadvertently broken while it is still in the socket. In addition to the possible electrical hazards, the glass envelope that encloses the filament and glass stem encasing the filament is completely shattered, leaving dangerous and sharp remnants of the glass envelope protruding from the light socket. Oftentimes, the threaded metal shell in the base of the light bulb is tightly engaged with the threaded wall of the socket. There is nothing to grasp and turn to remove the broken light bulb from the socket. It may be difficult also to electrically isolate and inactivate the wiring leading to the socket, leaving an electrical hazard in addition to a physical hazard.

Accordingly, one object of the present invention is to provide an improved broken bulb remover.

Another object of the invention is to provide a broken bulb remover which guards against electrical hazards.

Another object of the invention is to provide a broken bulb remover which guards against physical hazards from broken glass.

Another object of the invention is to provide a broken bulb remover that is inexpensive and designed for mass production and easy assembly.

SUMMARY OF THE INVENTION

Briefly stated, the invention comprises a broken bulb remover especially adapted for removing a broken light bulb by engaging and twisting the glass stem enclosing the filament leads while stabilizing the tool against the glass coating bonded to the threaded metal wall of the bulb. The broken bulb remover comprises a pair of longitudinal members of non-conductive material having handle sections on one end thereof, substantially semi-cylindrical engagement sections on the other end thereof, and transversely extending fulcrum sections disposed therebetween. The fulcrum sections include a mating pin and socket to connect the longitudinal members together and allow pivoting action, so that the engagement sections separate when the handle sections are squeezed together. The engagement sections have internal ribs adapted for engagement with the glass stem and external semi-cylindrical surfaces for engaging and stabilizing the tool against the internal glass coating of the broken light bulb when the tool is rotated to unscrew the remaining portions of the broken bulb. A transparent non-conductive shield is mounted around the fulcrum sections to protect against electrical shock and broken glass.

DRAWING

Figure 1:
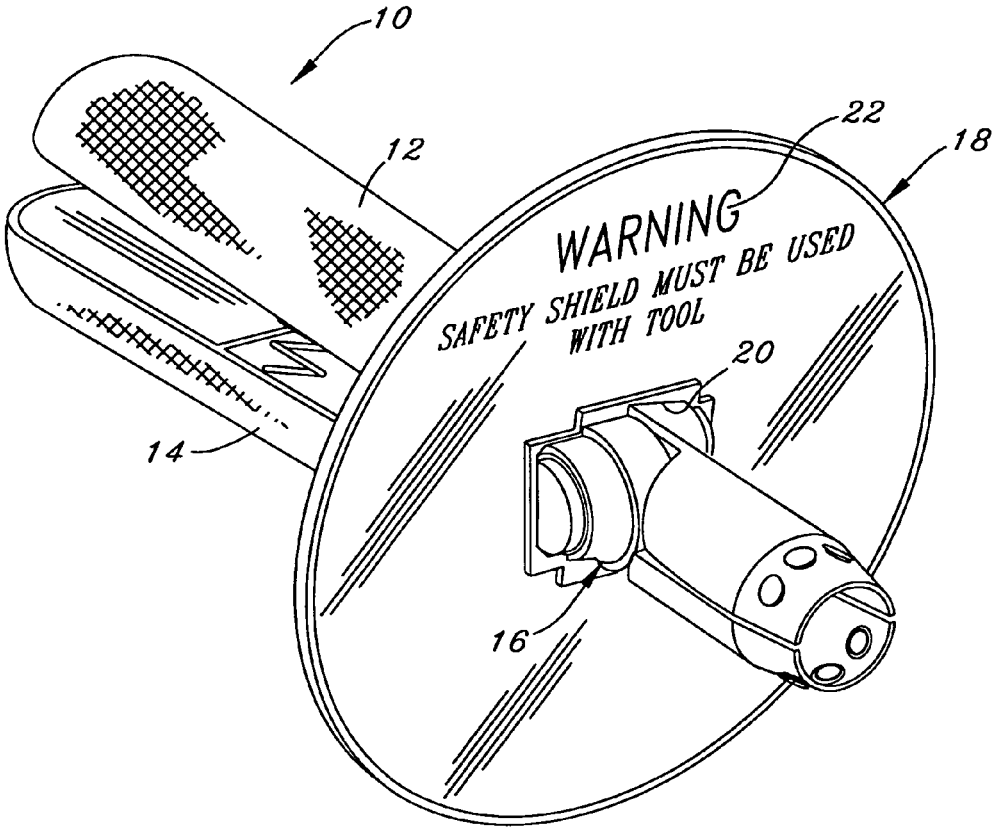
Figure 2:
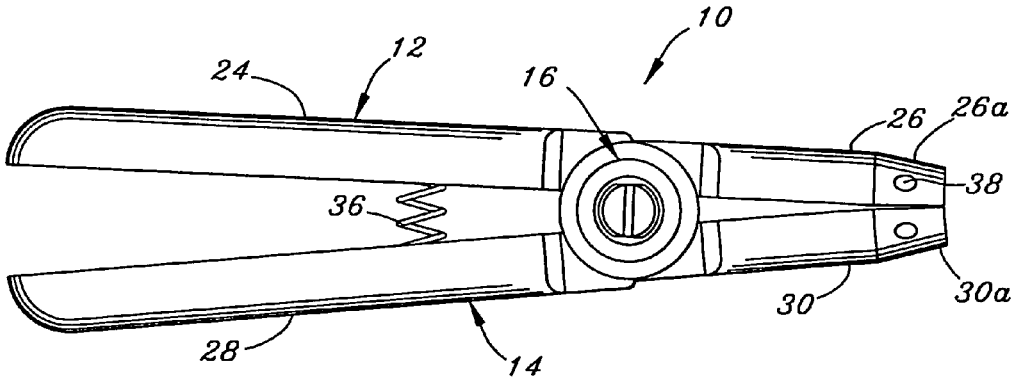
Figure 3:
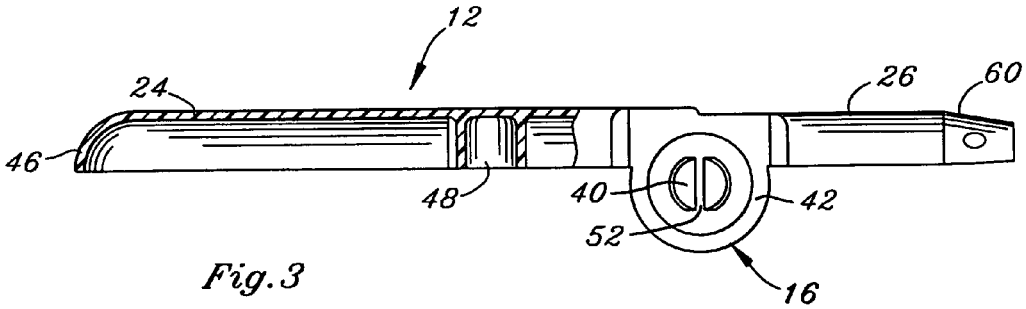
Figure 4:
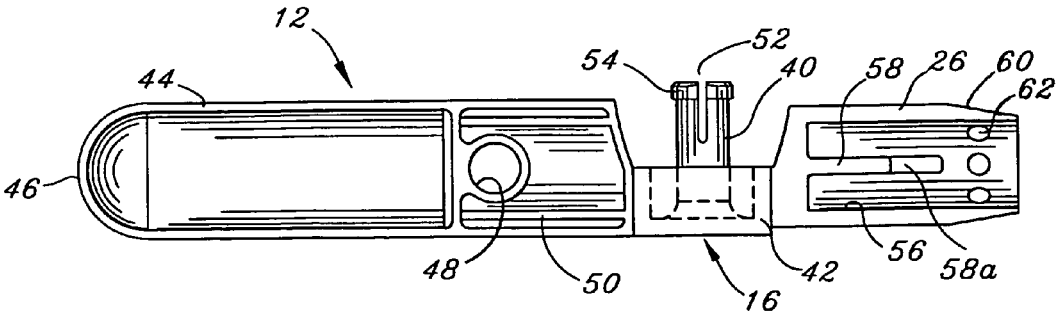
Figure 5:
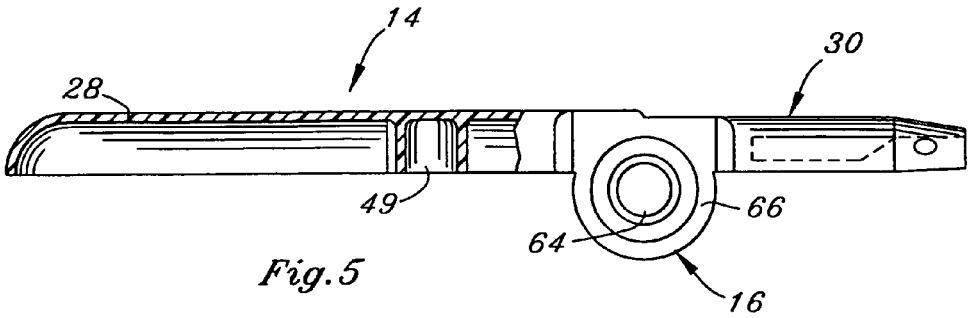
Figure 6:
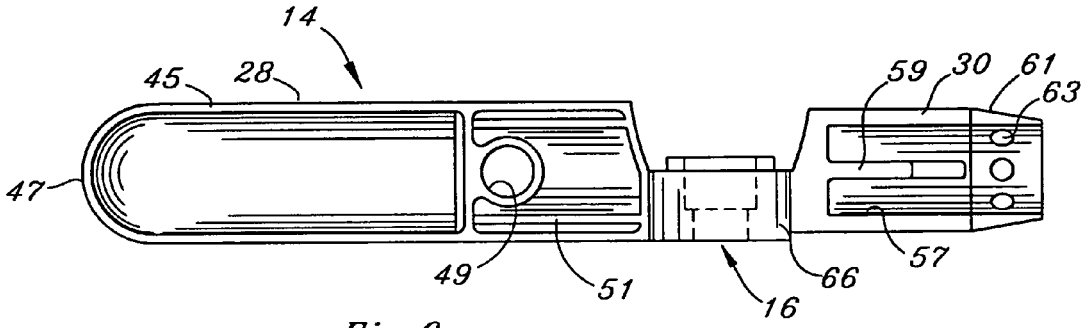
Figure 7:
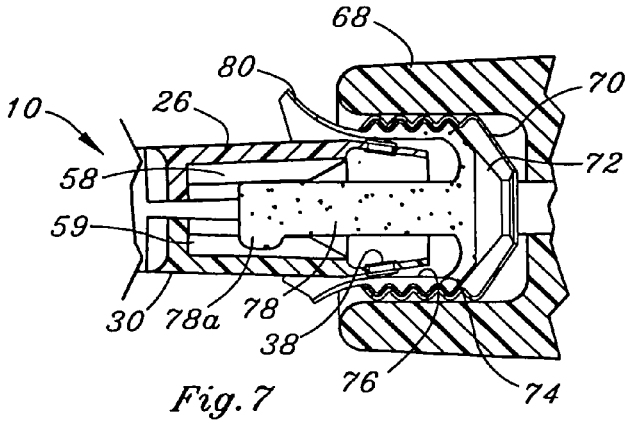

Other objects and advantages of the invention will be better understood by reference to the following description, taken in connection with the accompanying drawing, in which:

FIG. 1 is a perspective drawing of the broken bulb remover with protective shield attached, FIG. 2 is a side elevational view of the broken bulb remover without protective shield, FIG. 3 is a side elevational view of one longitudinal member before assembly, FIG. 4 is a plan view of the longitudinal member of FIG. 3, FIG. 5 is a side elevational view of the other longitudinal member before assembly, FIG. 6 is a plan view of the longitudinal member of FIG. 5, and FIG. 7 is an enlarged partial view of the broken bulb remover together with portions of a broken bulb illustrating operation of the invention.

DETAILED DESCRIPTION

Referring to FIG. 1 of the drawing, the broken bulb remover is shown generally at 10 to comprise an assembly of a first longitudinal member 12 and a second longitudinal member 14. The longitudinal members, which are made of non-conductive material such as PVC, are connected together at a fulcrum section shown generally at 16. A protective shield 18 of transparent conductive material such as Lucite comprises a circular disc with a central opening 20 conformed to fit the contours of fulcrum section 16. A warning message 22 is imprinted on the shield 18.

FIG. 2 of the drawing illustrates the assembled broken bulb remover 10 without the protective shield 18 in order not to obscure tile details. The upper longitudinal member 12 comprises a handle section 24 on one end and an engagement section 26 on the other. Similarly, the lower longitudinal member 14 comprises a handle section 28 on one end and an engagement section 30 on the other. The fulcrum section 16 between the opposed handle sections 24, 28 and engagement sections 26, 30 is made up of a transversely extending pin which is integral with the longitudinal member 12 and a complementary transversely extending socket which is integral with the lower longitudinal member 14. The fulcrum pin and fulcrum socket are arranged such that the longitudinal members are freely pivotable about them and such that, contrary to the normal pliers action, the engagement sections 26, 30 separate from one another when the handle sections 24, 28 are squeezed.

A light compression spring 36 between handles serve to bias the handles apart and the engagement sections together as shown in FIG. 2.

The engagement sections 26, 30 are adapted both internally and externally to provide engagement with the glass stem and the glass coating respectively of the remaining portions of the broken light bulb. Internal ribs, not seen in FIG. 2, receive and engage portions of the glass stem so that torque can be applied. In the preferred form shown in FIG. 2, the exterior surfaces are semi-cylindrical and include a slight taper at 26*a*, 30*a*. A number of circumferentially spaced tabs of a soft contact material, such as silicone, shown at reference number 38, center and stabilize the tool.

Reference to FIGS. 3 and 4 together show the details of the upper longitudinal member 12. Member 12 is generally semi-cylindrical in shape on either end with an integral transversely extending pin 40 extending from a boss 42. The handle section 24 has a fairly thin wall 44 which extends downward to close the end at 46. As seen in the plan view of FIG. 4, a circular well 48 is provided to receive a spring (not shown). Strengthening ribs 50 complete the handle section. The fulcrum section 16, comprising transversely extending pin and boss 42, is integrally formed with the longitudinal member. Pin 40 is bifurcated at 52 and has an enlarged head 54 to allow it to contract and fit into the fulcrum socket with a snap fit during assembly.

The engagement section 26 is generally semi-cylindrical in shape with a semi-cylindrical external wall 56 and a radial internal rib 58. Rib 58 is sloped at 58*a* so as guide the glass stem of a broken bulb onto the rib.

The end of the engagement section is tapered slightly as shown by reference numeral 60 and a series of circumferentially spaced holes 62 extend around the semi-cylindrical wall. Holes 62 are used to receive the silicone tabs 38 shown at FIG. 2.

Referring to FIGS. 5 and 6 together, the lower longitudinal member 14 is shown. The handle section 28 is formed substantially identical to the handle section of the upper longitudinal member with a wall 45, downwardly curved end 47, spring well 49 and strengthening rib 51. The engagement end 30 is formed substantially identical to the engagement end of the upper longitudinal member, having a semi-cylindrical external wall 57, a radial internal rib 59 with a sloped end, and a tapered end section 61 with circumferentially spaced holes 63. Fulcrum section 16 comprises fulcrum socket 64 formed in a boss 66. Socket 64 is a cylindrical hole extending transversely of the longitudinal member and dimensioned to receive the fulcrum pin 40 to allow pivoting action and to retain the fulcrum pin with a snap fit when it is assembled so as to connect the longitudinal members together.

OPERATION

Referring now to FIG. 7 of the drawing, a partial view is shown of the broken bulb remover with only the engagement sections 26, 30 depicted. A portion of a light bulb socket is indicated by a housing 68 holding a threaded conductive metal socket 70. The base 68 may take many different forms and shapes well known in the art. The base of a broken light bulb is disposed in socket 70 and indicated generally at 72. The broken bulb includes a metal shell 74 threaded on the exterior and screwed into socket 70. A glass coating 76 on the inside of the shell is integral with a stem 78 supporting leads to the filament (not shown). The stem generally has an enlarged end consisting of diametrically opposed flared portions 78*a*. The coating 76 is also integral with the glass envelope of the light bulb, which is missing, leaving only projecting jagged remnants 80. The engagement sections 26, 30 of the broken bulb remover 10 have been inserted into the cavity between coating 76 and stem 78 so that the circumferentially spaced tabs 38 are in contact with glass coating 76. At the same time, the stem 78 is guided between the radial internal ribs 58, 59. The flared portions 78*a* of the stem extend radially beyond the internal diameter of the ribs 58, 59. Slight rotation causes the flared portions to interfere and provided added gripping action of the ribs. One such flared portion 58*a* is seen in front of rib 59 in FIG. 7 and the other is behind rib 58. Rotation of the broken bulb remover, while maintaining the soft tabs 38 in contact with glass coating 76 to stabilize and center the tool, allows an even torque to be applied to the glass stem. This enables the user to unscrew tile light bulb base 72 from socket 70 without breaking the stem. During this operation, the user is protected from electrical and physical hazards by the protective shield 18.

While there has been described what is considered to be the preferred embodiment of the invention, other modifications will occur to those skilled in the art, and it is desired to secure in the appended claims all such modifications as fall within the true spirit and scope of the invention.

What is claimed is:

1. A broken bulb remover especially adapted for removing a broken light bulb from a socket, said broken light bulb having a metal shell threaded into said socket, a glass coating bonded to said metal shell, and a glass stern, said broken bulb remover comprising:

first and second longitudinal members each having a handle section on one end thereof and a semi-circular engagement section on the other end thereof, said longitudinal members being pivotably connected together at a fulcrum section, said engagement sections each having an exterior surface adapted for engagement with said glass coating of the broken light bulb when the handle sections are squeezed, and first and second radially extending internal ribs disposed inside the engagement sections of the first and second longitudinal members, respectively, said ribs being arranged to engage said glass stem so as to enable removal of the broken bulb.

2. The broken bulb remover according to claim 1, wherein said longitudinal members are made of non-conductive material.

3. The broken bulb remover according to claim 1, wherein each of said engagement sections includes a plurality of circumferentially spaced pads of soft material protruding substantially radially from the engagement sections.

4. The broken bulb remover according to claim 1, wherein said fulcrum section comprises a transversely extending fulcrum pin integral with one of said longitudinal members, and a transversely extending fulcrum socket integral with the other of said longitudinal members, said fulcrum socket being arranged and dimensioned to receive said fulcrum pin to connect said longitudinal members together and to allow pivoting motion.

5. The broken bulb remover according to claim 1 and further including a transparent shield of non-conductive material having an opening in the center thereof arranged to fit over said fulcrum sections to protect a user of the broken bulb remover.

6. A broken bulb remover especially adapted for removing a broken light bulb from a socket, said broken light bulb having a metal shell threaded into said socket, a glass coating bonded to said metal shell, and a glass stern having flared portions on an end thereof, said broken bulb remover comprising:

a first longitudinal member having a first handle section on one end thereof, a first substantially semi-cylindrical engagement section on the other end thereof, and a transversely extending fulcrum pin disposed therebetween, a second longitudinal member having a second handle section on one end thereof, a second substantially semi-cylindrical engagement section on the other end thereof, and a transversely extending fulcrum socket disposed there between, said fulcrum socket being arranged and dimensioned to receive said fulcrum pin to connect said longitudinal members together and to allow pivoting action, spring means biasing said first and second handle sections apart, said first and second engagement sections each having an external side adapted for engagement with said glass coating of the broken light bulb when the handle sections are squeezed, and first and second radially extending ribs disposed inside the first and second engagement sections, respectively, and dimensioned to engage said glass stem flared portions.

7. The broken bulb remover according to claim 6, wherein said longitudinal members are made of non-conductive material.

8. The broken bulb remover according to claim 6, wherein said engagement sections include a plurality of circumferentially spaced pads of soft material protruding substantially radially from the engagement sections.

9. The broken bulb remover according to claim 6, wherein said fulcrum pin is bifurcated and defines an enlarged end thereon, whereby the fulcrum pin may be inserted into the fulcrum socket and retained with a snap fit.

10. The broken bulb remover according to claim 6 and further including a transparent shield of non-conductive material having an opening in the center thereof arranged to fit over said fulcrum sections to protect a user of the broken bulb remover.

* * * * *

UNITED STATES PATENT AND TRADEMARK OFFICE

CERTIFICATE OF CORRECTION

PATENT NO. : 6,904,830 B1
DATED : June 14, 2005
INVENTOR(S) : Yvon Desaulniers

It is certified that error appears in the above-identified patent and that said Letters Patent is hereby corrected as shown below:

Column 4,
Lines 1 and 40, “stern” should read -- stem --.

Signed and Sealed this

Twentieth Day of September, 2005

JON W. DUDAS
*Director of the United States Patent and Trademark Office*